United States Patent [19]

Dorman et al.

[11] 4,318,537

[45] Mar. 9, 1982

[54] CUTTING SURFACE ASSEMBLY

[75] Inventors: William H. Dorman, Corning; Jerome J. Smith, Painted Post, both of N.Y.

[73] Assignee: Corning Glass Works, Corning, N.Y.

[21] Appl. No.: 162,019

[22] Filed: Jun. 23, 1980

[51] Int. Cl.[3] ..... B23Q 3/00

[52] U.S. Cl. ..... 269/302.1; 248/27.1; 269/289 R

[58] Field of Search ..... 269/289 R, 302.1; D7/46; 248/27.1, 27.3

[56] References Cited

U.S. PATENT DOCUMENTS

| | | | |
|---|---|---|---|
| 2,921,320 | 1/1960 | Lantz | 248/27.1 |
| 3,358,190 | 12/1967 | Mathison | 248/27.1 X |
| 3,613,177 | 10/1971 | Davis | 248/27.1 X |
| 3,701,171 | 10/1972 | Fritzache | 248/27.1 |
| 4,243,016 | 1/1981 | Kristen et al. . | |

FOREIGN PATENT DOCUMENTS

| | | | |
|---|---|---|---|
| 12153 | of 1903 | United Kingdom | 269/302.1 |

*Primary Examiner*—Robert C. Watson

*Attorney, Agent, or Firm*—John P. DeLuca

[57] ABSTRACT

There has been provided a drop-in cutting board assembly for an apertured countertop, wherein a vitreous cutting surface is located over a backing or strengthening member. A T-band holds the cutting surface and backing member together by means of a pair of opposed flanges joined together by an annular band located about the periphery thereof. An outwardly facing proportion of one of the flanges engages a peripheral margin of the countertop aperture to support the assembly in place and a channel formed integrally of the annular band extends below the countertop. A latch engages the channel and has free ends for engaging both the rearward portion of the backing member and the countertop for securing the assembly firmly within the aperture countertop.

6 Claims, 4 Drawing Figures

CUTTING SURFACE ASSEMBLY

BACKGROUND OF THE INVENTION

The invention relates to drop-in or built-in cutting boards which are normally secured in an appropriately apertured portion of a countertop or other work surface.

One such system utilizes a glass-ceramic plate mounted in the countertop by means of a frame in the form of a T-shaped band secured about the periphery of the plate. The band has an outwardly projecting flange adapted to overlap the aperture and rest on the countertop, and a downwardly depending annular rim with a lower portion thereof having a channel for pivotally supporting an anchoring clip. Normally such anchoring clips have a centrally located latch which is adapted to mate with the channel and opposed free arms, with one such arm for engaging the rearward portion of the countertop and the other having a threaded aperture therein for receiving a set screw. As the set screw is advanced it engages a rearward portion of the cutting board and causes the anchoring clip to pivot about the latch, to urge the other free arm to engage the rear of the countertop and thus pull the T-band inwardly to thus secure the assembly in the countertop. The set screw also engages the rearward side of the glass-ceramic plate to secure it in the band and support it against loads applied on the front side.

It is known that vitreous materials (glass and glass-ceramics) may be manufactured in such a way that they exhibit a high modulus of rupture (MOR). It is also known that such materials tend to fail in tension, especially when point loaded. In the cutting board assembly just described, the upper or front surface thereof is subjected to compressive forces of the user which normally would not cause breakage. However, should the upper surface of the cutting board (sometimes hereinafter board) be subjected to an unreasonable excessive load, the rearward portion of the board is placed in tension by such load. Further, the set screws utilized for sensing the board in the countertop may result in point load sources about the periphery thereof, which tend to increase the tensile forces thereof. As set forth above, the set screws not only secure the board in the countertop, they also function to support any load imposed thereon and transmitted thereto at various contact points about the periphery. Excessive point loading, of course, which may occur from improper installation or unreasonable use, may raise the applied force to some value above the MOR of the material and thus cause failure.

It is also important to note that the described prior arrangement requires assembly at the installation site. That is, the frame and cutting board assembly are shipped separately and installed in the formed opening of the countertop. Anchoring clips are manually installed about the frame in a more or less random spacing. It should be clear that some set screws may be torqued down with more force than others, and thus, the countertop may be subject to irregular or uneven stresses. The above procedure is also rather time consuming, since the frame and cutting board are shipped unassembled. As the anchoring procedure is accomplished, someone or something must be used to hold the assembly in place until it is secured properly. This cumbersome procedure could result in checking of the vitreous cutting board thereby greatly reducing its strength.

The present invention solves the problems referred to above by providing a drop-in unit which readily supports itself in the apertured countertop prior to installation and which includes a backing member capable of sustaining relatively high and typically nonuniform forces exerted on the assembly.

SUMMARY OF THE INVENTION

There has been provided a drop-in cutting board assembly adapted to be mounted in an appropriately apertured countertop. The assembly includes a relatively hard vitreous cutting surface being bound by a peripheral margin, a support member having a similar peripheral bounding margin layered therebehind and a surrounding frame mounted thereabout. The frame includes, a first flange extending inwardly of the assembly for overlapping the entire peripheral margin of the cutting surface and extending outward and being adapted to entirely overlap a bounding peripheral margin of the aperture in the countertop when the assembly is dropped therein. The frame further includes an annular band portion extending distally from the first flange and a segmented second flange integral therewith extending inwardly of the assembly for overlapping portions of the peripheral margin of the backing member in opposition to the first flange, to secure the layered cutting surface and backing member therebetween. A channel member formed integrally with the annular band extends beyond a rearward portion of the backing member. Means is provided for pivotally engaging the channel member having opposed axial arms, one each adapted for engaging the rearward portion of the countertop and the other having a threaded aperture for receiving therein a set screw adapted to be advanced against the rearward portion of the backing member to thereby fasten the assembly securely in place.

DESCRIPTION OF THE PREFERRED EMBODIMENT

Figure 1:
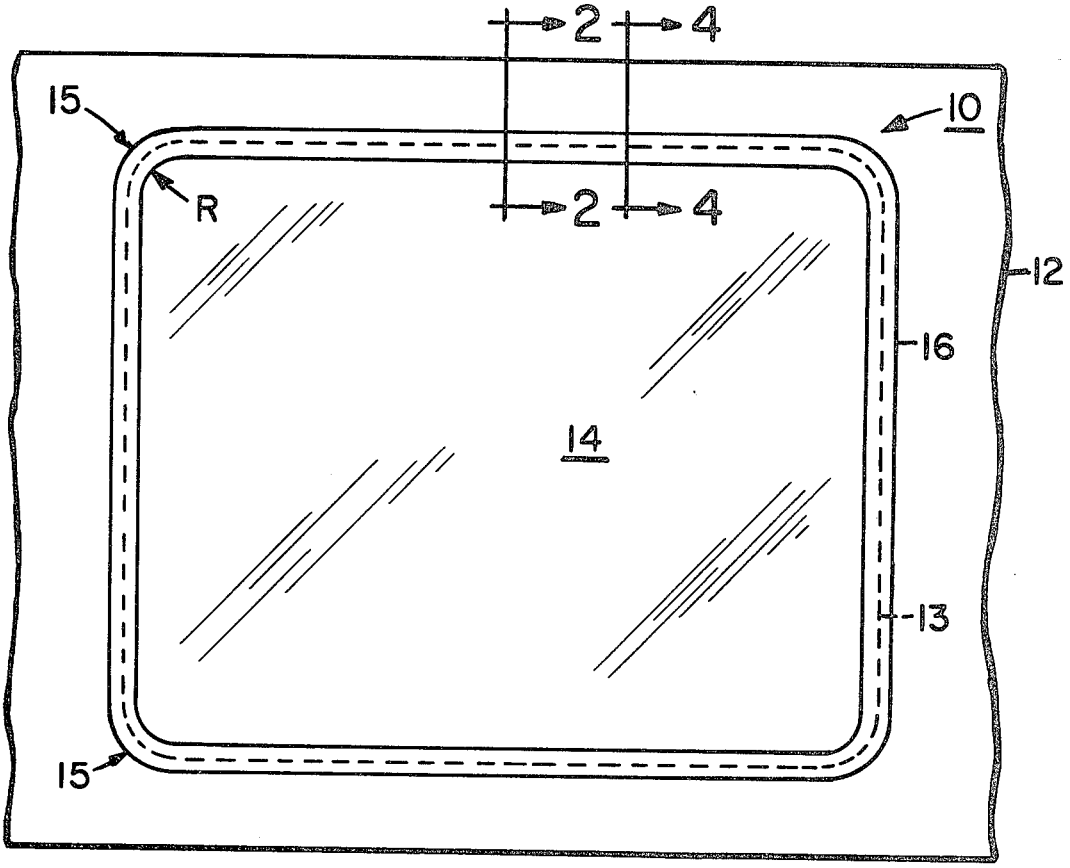
FIG. 1 is a top plan view of a cutting board assembly mounted in a portion of a countertop.
Figure 2:
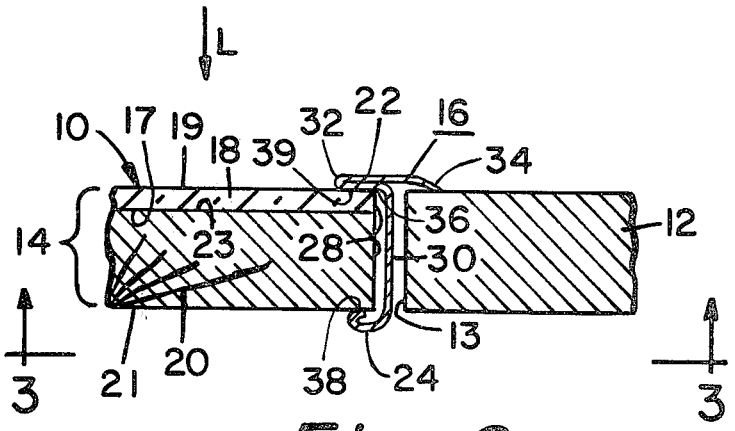
FIG. 2 is an enlarged side sectional elevation taken along line 2—2 of FIG. 1.
Figure 3:
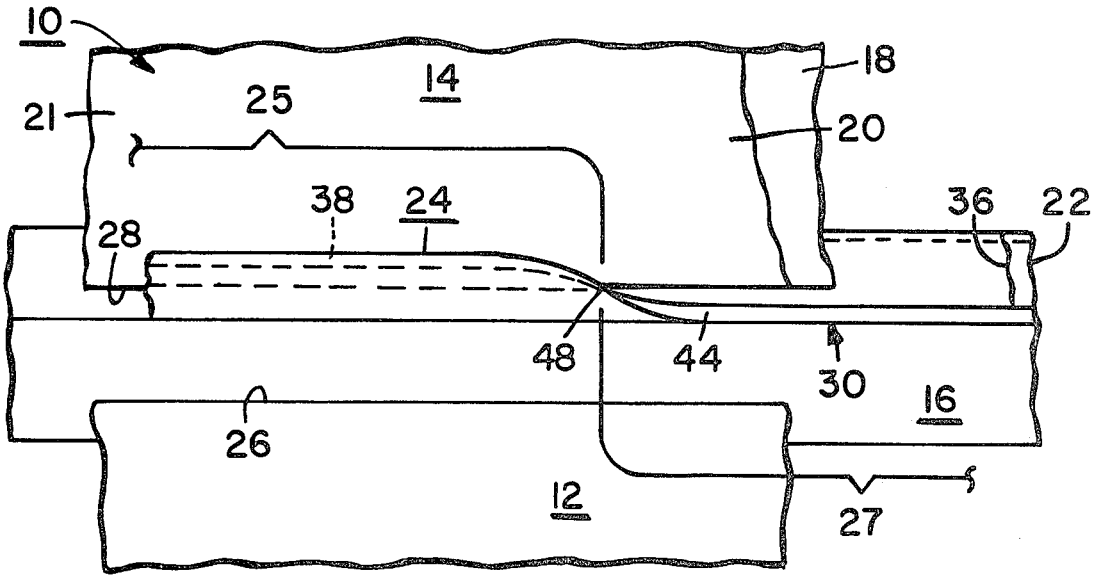
FIG. 3 is a bottom view in elevation taken along line 3—3 of FIG. 2 further enlarged for clarity.

A drop-in cutting board assembly 10 is generally illustrated in FIG. 1. In a typical application the assembly 10 is located in an aperture 13 of a conventional countertop 12. A central portion 14 including a cutting surface, hereinafter described, is mounted within the aperture 13 by means of a peripheral rim or frame 16. FIGS. 2 and 3 detailed below show further features of the arrangement.

The assembly 10 includes three main parts formed into a unitary structure. The central portion 14 of the assembly 10 includes a sheet of vitreous material 18 having a smooth normally upwardly facing surface 19 used for cutting, and a backing plate or backing member 20, such as a plywood sheet, for supporting the plate 18 against localized loading. Rim 16 surrounds or frames a peripheral margin 28 of the central portion 14 to form the assembly 10.

The backing plate 20 is layered against sheet 14 so that its front side 23 is in intimate contact with a back side 17 of the sheet 14. Thus, if a load L is placed against front surface 19 of sheet 18 the back surface will be supported against excess tensile forces by the backing plate 20.

The rim 16 includes upper or counter level flange 22 and lower or below counter level flange 24 joined by web 30. Each of the respective upper and lower flanges 22 and 24 have opposed upper and lower bearing surfaces 36 and 38, respectively, to urge the vitreous sheet 18 and backing plate 20 together in intimate contact. The upper bearing surface 36 provides a relatively uniform force about the margin 28 of the sheet 18, whereas the lower bearing surface 38 is selectively located about the margin 28 of the backing member 20 as hereinafter described. A resilient sealant material such as silicone tape 39 is wrapped about the peripheral margin 28 of the sheet 18 to seal the interface between it and the upper bearing surface 36. The assembly 10 is dropped into aperture 13 of the countertop 12 which is appropriately sized to accommodate it.

The counter level flange 22 includes an outboard end 34 which extends beyond the aperture 13 to engage the countertop 12 and support the assembly 10 therein. A corresponding inboard end 32 of the upper flange 22 extends over the margin 28 of the plate 18 in a similar fashion.

In FIG. 3 a fragmented portion or segment 25 of the lower flange 24 is more fully illustrated. Selected lengths of the web 30 of rim 16 are rolled by a conventional sheet metal forming tool over corresponding portions of the margin 28 of the backing plate 20. Rolled over portion 25 includes lower bearing surface 38 extending peripherally over a portion of a rear surface 21 of backing plate 20 to a point shown at 48 (to the right in the drawing, and to the left with an opposite end thereof being a mirror image of the portion shown.) Other portions 27 of the web 30 remain substantially vertical as illustrated in FIG. 3 except for the channel member 44 (FIGS. 3 and 4) formed on the lower portion thereof. The web 30 is thus alternately rolled over the rear side of the backing member 20 at various points about the peripheral margin 28 forming the rolled over portions or segments 25 of second flange 24, each of which is relatively long so as to more evenly distribute the forces or loads placed upon the central portion 14 of the assembly 10 and thereby avoid point loading.

Figure 4:
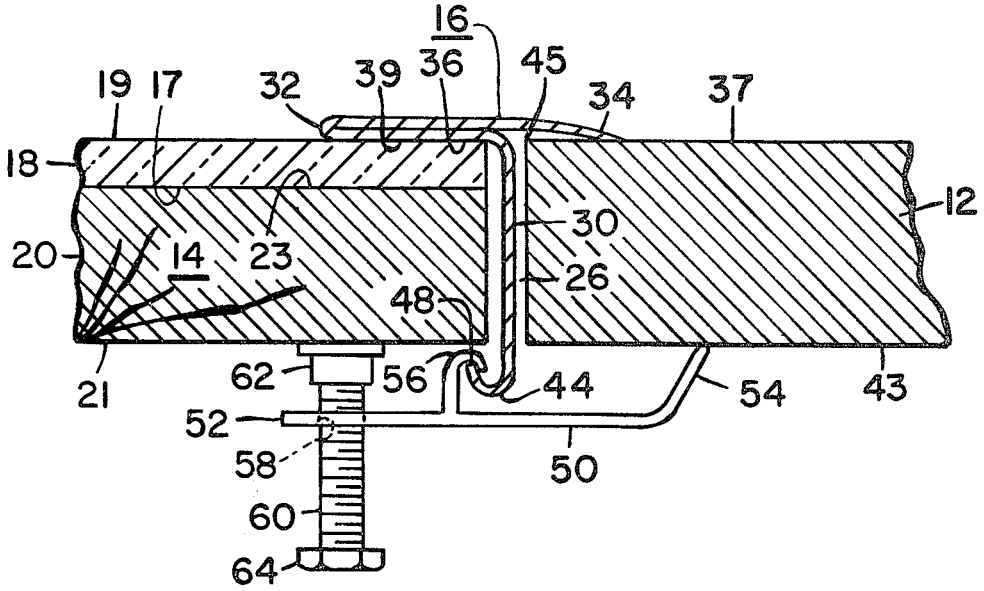
FIG. 4 is an enlarged side sectional elevation taken along line 4—4 of FIG. 1.

During initial fabrication of the assembly 10 the rim 16, beginning as an elongated flat strip of sheet metal, is formed as shown in FIG. 4, that is, it is essentially in a T shape extending from the outboard end 34 of upper flange 22, which engages the countertop 12, to the inboard end 32 thereof and thence being rolled back over itself forming the upper bearing surface 36. Thence, at about the midpoint between the inboard and outboard ends 32 and 34 respectively, the web 30 extends downwardly and is rolled over itself into a channel member 44 towards a mating end 48. The band 16 is cut to length and formed into the rectangular shape illustrated in FIG. 1 with free ends thereof (not shown) butt welded and polished. Corners 15 would be rounded with an inside radius R of about ½". The central portion 14 including the glass-ceramic plate 18 and backing plate 20 are loaded into the rim 16 and the lower flange portion 24 is thereafter formed by rolling over portions or segments 25 of the channel member 44 against the back surface 21 of the backing member 20, as shown in FIGS. 2 and 3 to form the rear or lower bearing surface 38.

Unrolled or intermediate portions 27 of the channel 44 are useful for providing means for anchoring the assembly 10 to the countertop 12 as illustrated most clearly in FIG. 4. An elongated anchoring member 50 has inboard and outboard arms 52 and 54 respectively and a more or less centrally located mating latch 56. The anchoring device 50 may be an extruded metal object having a depth dimension (into the page) of about ½", an overall width of about 1½", and a height of about ¾". The latch 56 is positioned over the mating end 48 of the channel 44. The inboard arm 52 has a threaded opening 58 for accommodating a set screw 60. An upper end thereof has a cap 62 located thereon which may be a polyethylene material and a lower end thereof forms head 64. The set screw 60 may be advanced so as to engage the back surface 21 of the backing member 20 as shown, thus causing the inboard arm 52 to pivot downwardly about the latch 56 and cause the outboard arm 54 to move upwardly in a pivotal motion to bear against back side 43 of the countertop 12. Consequently the latch 56 engaging the mating end 48 of the channel 44 draws the web 30 and upper flange portion 22 downwardly. The outboard end 34 of the upper flange 24 engages upper or forward face 37 of the countertop 12 and thus firmly secures the assembly 10 in the aperture 26. It should be noted that an appropriate number of the anchoring devices 50 may be spaced about or located in the intermediate portions 27 between the segments 25 of the lower flange 24.

It has been discovered that it is quite possible to modify the upper flange 22 of the rim 16, so that the portion doubled over on itself at 36 (which has also been referred to above as the bearing surface 36) is rolled over from the outboard end 34 and the doubled over material rests on the countertop 12. Either system will work in essentially the same manner except that a double thickness located outboard of the rim 16 would have a somewhat higher strength and rounded corners 15 of rim 16 would have an inside radius of about 1". Further the anchoring clip 50 may be reversed with the set screw located at the outboard end, although the configuration shown is preferred.

It should be realized that since the assembly 10 is essentially in one piece, all the installed need do is simply cut the aperture 13 in the countertop 12, drop in the assembly 10, place a number of the anchoring devices 50 thereabout and advance the respective set screws 60 to a proper torque to secure the device in place. If desired, a silicone or putter material 45 may be provided to seal the outboard end 34 of the flange 22 with the countertop 12.

The present invention therefore provides a simplified unitary construction for a cutting board assembly adapted to be simply and readily installed in an appropriately apertured countertop. Further the backing plate reduces the possibility of tensile forces exceeding the modulus of rupture of the vitreous sheet by supporting the back side thereof against excess tensile forces. In the event the ceramic breaks or cracks under excess load the backing member 20 will prevent a catastrophic breakthrough. The assembly 10 has the advantage of high strength in its support and stability in the countertop 12. The segmented lower flange 24 not only cooperates with the upper flange 22 to secure the sheet 18 and backing plate 20 in the rim 16, but each segment 25 of lower flange 24 is elongated to distribute the applied load and is thus more reliable.

We claim:

1. A drop-in cutting board assembly adapted to be mounted in an appropriately apertured countertop comprising: a relatively hard vitreous cutting surface being bounded by a peripheral margin; a support member having a similar peripheral bounding margin layered therebehind; a surrounding frame mounted thereabout, said frame including a first flange engaging an outwardly facing portion of the cutting surface and overlapping the entire peripheral margin thereof forming a first bearing surface thereagainst and adapted to engage an outwardly facing portion of the countertop entirely along a bounding peripheral margin of the aperture when the assembly is dropped therein, an annular band portion extending distally from the first flange, and a second flange integral with said band portion, said second flange forming a second bearing surface for overlapping a portion of the peripheral margin of the backing member and engaging a rearward surface of the backing member in opposition to the first bearing surface of the first flange to secure the layered cutting surface and backing member therebetween, and a channel member integral with said annular band extending beyond the rearward surface of the backing member; and anchoring means adapted to pivotally engage the channel member having opposed free arm extending therefrom for respectively engaging rearward portions of each of a backing member and the countertop for securing the assembly within the aperture.

2. The cutting board assembly of claim 1 wherein the frame is formed of a length of relatively thin sheet metal being sufficiently wide to form a T-shaped member in cross section, beginning at an outboard portion of the first flange and extending radially inwardly of the assembly to engage the cutting surface at an inboard end thereof, thence being reversed on itself to about a mid point of said first flange, and thence extending distally towards the rearward portion of the channel member which in turn extends as a U inwardly of the assembly, said frame being formed into a rectangular-like shape corresponding to the peripheral margin of the cutting surface and support member with free ends thereof butt welded, the second flange being formed from a portion of the channel member in situ after location of the vitreous cutting surface and backing member therein.

3. The cutting board assembly of claim 1 wherein the anchoring means further includes a set screw located in a threaded opening of at least one of the free arms, said set screw being adapted to advance against a rearward surface of the backing member to cause the opposed free arm to pivot upwardly against the rearward portion of the countertop and thereby draw the mating portions of the anchoring means and the channel member rearwardly of the assembly.

4. The cutting board assembly of claim 1 wherein the channel member and second flange are alternately spaced about the frame.

5. The cutting board assembly of claim 1 wherein a resilient sealant material is located between the first bearing surface of the first flange and the cutting surface.

6. The cutting board assembly of claim 1 wherein the frame is formed of a length of relatively thin sheet metal being sufficiently wide to form a T-shaped member in cross section beginning at an inboard portion of the first flange to engage the cutting surface and extending radially outwardly of the assembly to an outboard end, and thence being reversed on itself to about a mid point of said first flange and thence extending distally towards the rearward portion of the channel member which in turn exceeds as a U inwardly of the assembly, said frame being formed into a rectangular shape corresponding to the peripheral margin of the cutting surface and support member with free ends thereof butt welded, the second flange being formed from a portion of the channel in situ after location of the vitreous cutting surface and backing member thereon.

* * * * *

UNITED STATES PATENT AND TRADEMARK OFFICE

CERTIFICATE OF CORRECTION

PATENT NO. : 4,318,537

DATED : March 9, 1982

INVENTOR(S) : William H. Dorman & Jerome J. Smith

It is certified that error appears in the above-identified patent and that said Letters Patent are hereby corrected as shown below:

Column 1, line 43, "sensing" should be --securing--.

Column 1, line 68, "vir-" should be --vi- --.

Column 4, line 47, "installed" should be --installer--.

Column 4, line 52, "putter" should be --putty--.

Signed and Sealed this

*Twenty-first* Day of *December 1982*

[SEAL]

*Attest:*

GERALD J. MOSSINGHOFF

*Attesting Officer*

*Commissioner of Patents and Trademarks*